US006241511B1

(12) United States Patent
Hsu

(10) Patent No.: US 6,241,511 B1
(45) Date of Patent: Jun. 5, 2001

(54) ELECTRIC GAS LIGHTER WITH DUAL IGNITION SAFETY DEVICE

(76) Inventor: Huang-Hsi Hsu, 8F, No. 14, Lane 252, Chungshan N. Rd., Sec. 6, Taipei (TW)

( * ) Notice: Subject to any disclaimer, the term of this patent is extended or adjusted under 35 U.S.C. 154(b) by 0 days.

(21) Appl. No.: 09/689,877

(22) Filed: Oct. 13, 2000

(51) Int. Cl.[7] ..... F23Q 7/12

(52) U.S. Cl. ..... 431/255; 431/256; 431/344; 126/401; 126/405

(58) Field of Search ..... 431/153, 255, 431/256, 344, 142; 126/401–409, 414, 415, 229

(56) References Cited

U.S. PATENT DOCUMENTS 4,292,021 * 9/1981 Miyagawa ..... 431/255
4,516,933 * 5/1985 Buzzi ..... 431/255
5,496,169 * 3/1996 Chen ..... 431/255
5,865,614 * 2/1999 Hsu ..... 431/255
5,975,888 * 11/1999 Hsu ..... 431/255

* cited by examiner

*Primary Examiner*—James C. Yeung
(74) *Attorney, Agent, or Firm*—Bacon & Thomas, PLLC

(57) ABSTRACT

A gas lighter comprises a housing for receiving a fuel reservoir and a pivot plate, a spring-biased ignition button partially raised above the housing with bottom in contact with the pivot plate having a conductive contact, a spring-biased safety button partially raised below the housing, a high-voltage circuit device including a first contact coupled to ignition tube, a second contact coupled to a source, and a conductive pad coupled between the second contact and the stud. In use, depress the ignition button and the first safety button to form an electrical path from the source to the ignition tube for generating an arc, and the pivot plate is pivoted by the ignition button to open a gas outlet to introduce gas to the ignition tube for igniting the gas lighter.

5 Claims, 5 Drawing Sheets

ELECTRIC GAS LIGHTER WITH DUAL IGNITION SAFETY DEVICE

FIELD OF THE INVENTION

The present invention relates to a gas lighter and more particularly to an electric gas lighter with dual ignition safety device for preventing inadvertent ignition.

BACKGROUND OF THE INVENTION

The present inventor filed an application about electric gas lighter with Ser. No. 09/193,418 on Nov. 18, 1998, U.S. Pat. No. 5,975,888, which is shown in FIGS. 1 and 2. The gas lighter comprises a gas fuel reservoir 2, a high-voltage circuit device 3, and a housing 1 enclosed gas fuel reservoir 2 and high-voltage circuit device 3. Gas fuel reservoir 2 comprises a gas outlet 20, a hose 22 coupled to gas outlet 20, an ignition tube 24 in the front coupled to hose 22, and a pivot plate 26 on top of gas outlet 20. A conductive tube 16 and a sleeve 14 are put on ignition tube 24 sequentially. High-voltage circuit device 3 is powered by a source (e.g., cell) 4 for providing current to ignition tube 24. An ignition button 10 is partially raised above housing 1. An electrical path from source 4 to high-voltage circuit device 3 is formed by depressing ignition button 10. Ignition button 10 is always in contact with pivot plate 26. A movable safety button 12 having one end coupled to a spring is provided adjacent ignition button 10. In a locked position, ignition button 10 is secured by the laterally projected member from the bottom of safety button 12 by virtue of spring, thus preventing inadvertent ignition of ignition button 10.

In use, first push safety button 12 rearward to disengage safety button 12 from ignition button 10. Then depress ignition button 10 to enable the electrical path from source 4 to high-voltage circuit device 3 to generate a high-voltage current which is flowed to ignition tube 24 for generating an electric arc. At the same time, the blockage of gas outlet 20 by pivot plate 26 is lifted such that gas is immediately flowed to ignition tube 24 through hose 22. Thus a spark is generated at the mouth of ignition tube 24, resulting in the ignition of gas lighter.

However, the previous design suffered from a disadvantage. In detail, safety button 12 may be inadvertently pushed rearward to disengage from ignition button 10 by children. To the worse, ignition button 10 is also depressed thereafter. Accordingly, as stated above, the electrical path from source 4 to high-voltage circuit device 3 is formed to generate a spark at the mouth of ignition tube 24. Thus, it is desirable to provide an improved electric gas lighter with novel safety mechanism in order to overcome the above drawbacks of prior art.

SUMMARY OF THE INVENTION

It is an object of the present invention to provide an electric gas lighter with dual ignition safety device comprising a first safety button and an ignition button, whereby the gas lighter is ignited only when the first safety button and the ignition button both are activated.

It is another object of the present invention to provide an improved electric gas lighter with enhanced safety mechanism by providing a second safety button in addition to the first safety button and the ignition button such that the gas lighter is activated only when the safety buttons and the ignition button all are activated.

The above and other objects, features and advantages of the present invention will become apparent from the following detailed description taken with the accompanying drawings.

DETAILED DESCRIPTION OF THE PREFERRED EMBODIMENTS

Figure 1:
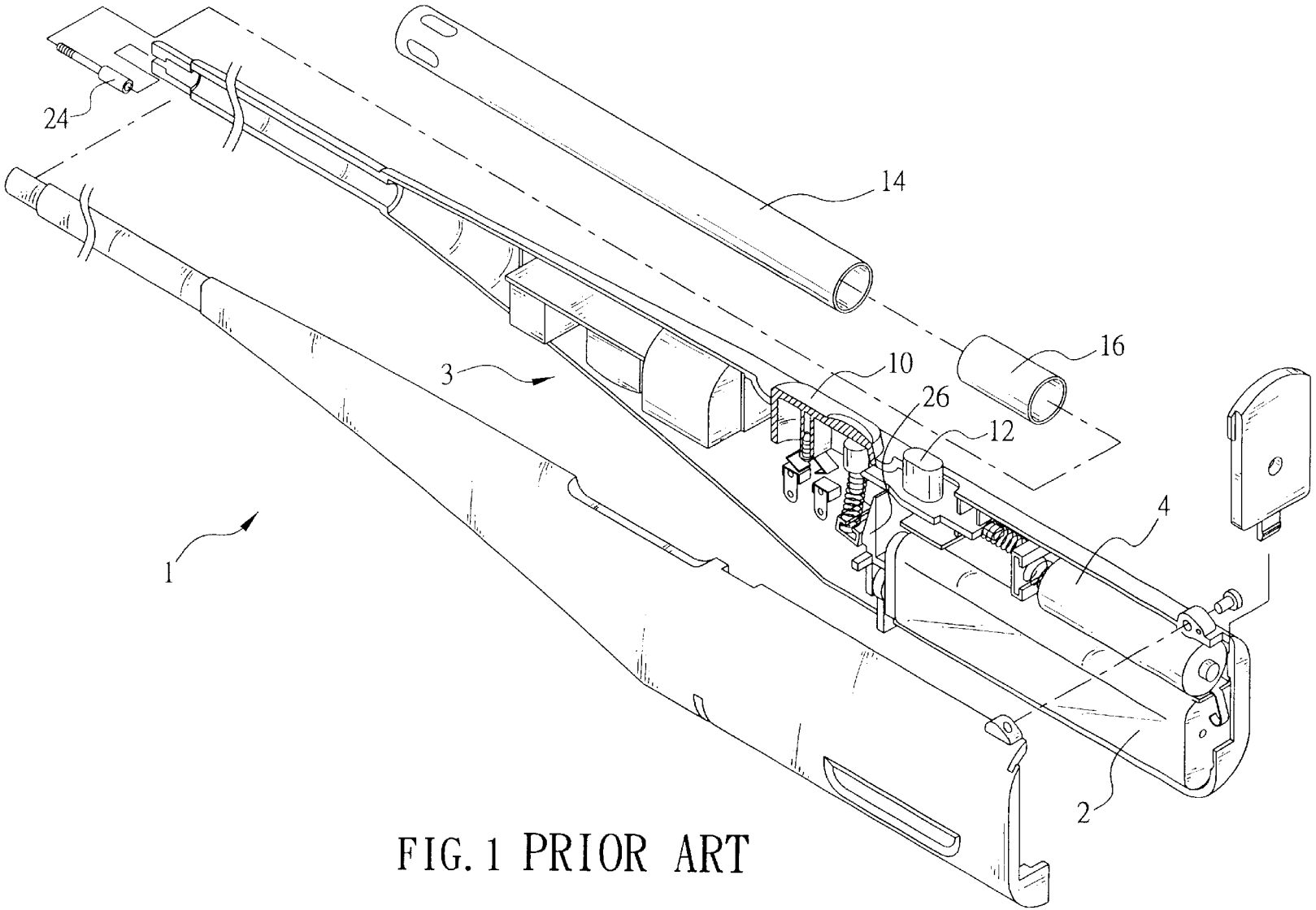
FIG. 1 PRIOR ART
FIG. 1 is an exploded view of a conventional electric gas lighter.
Figure 2:
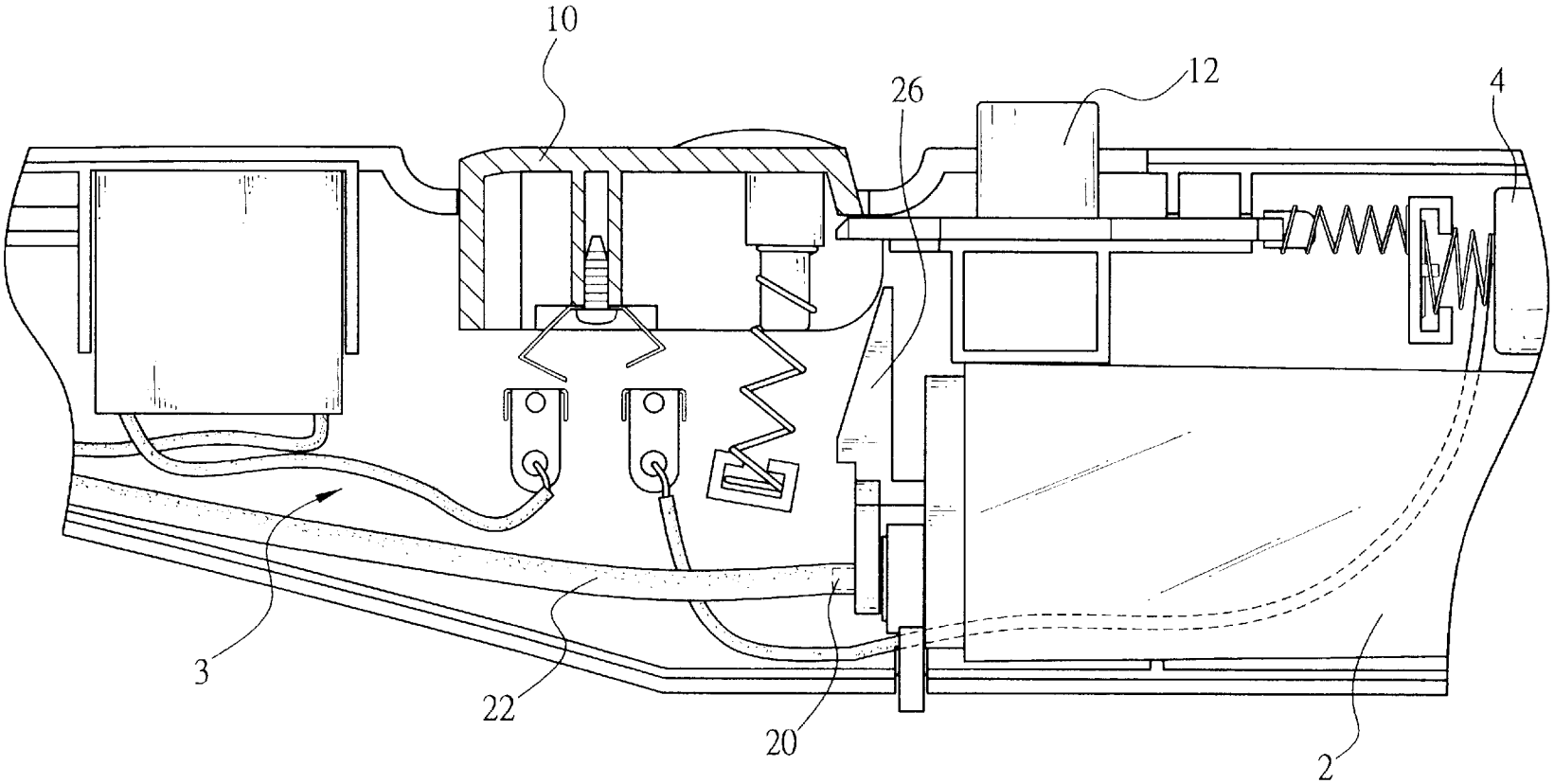
FIG. 2 PRIOR ART
FIG. 2 is a (partial cross-sectional view of the FIG. 1 gas lighter to illustrate the actuation mechanism thereof.
Figure 3:
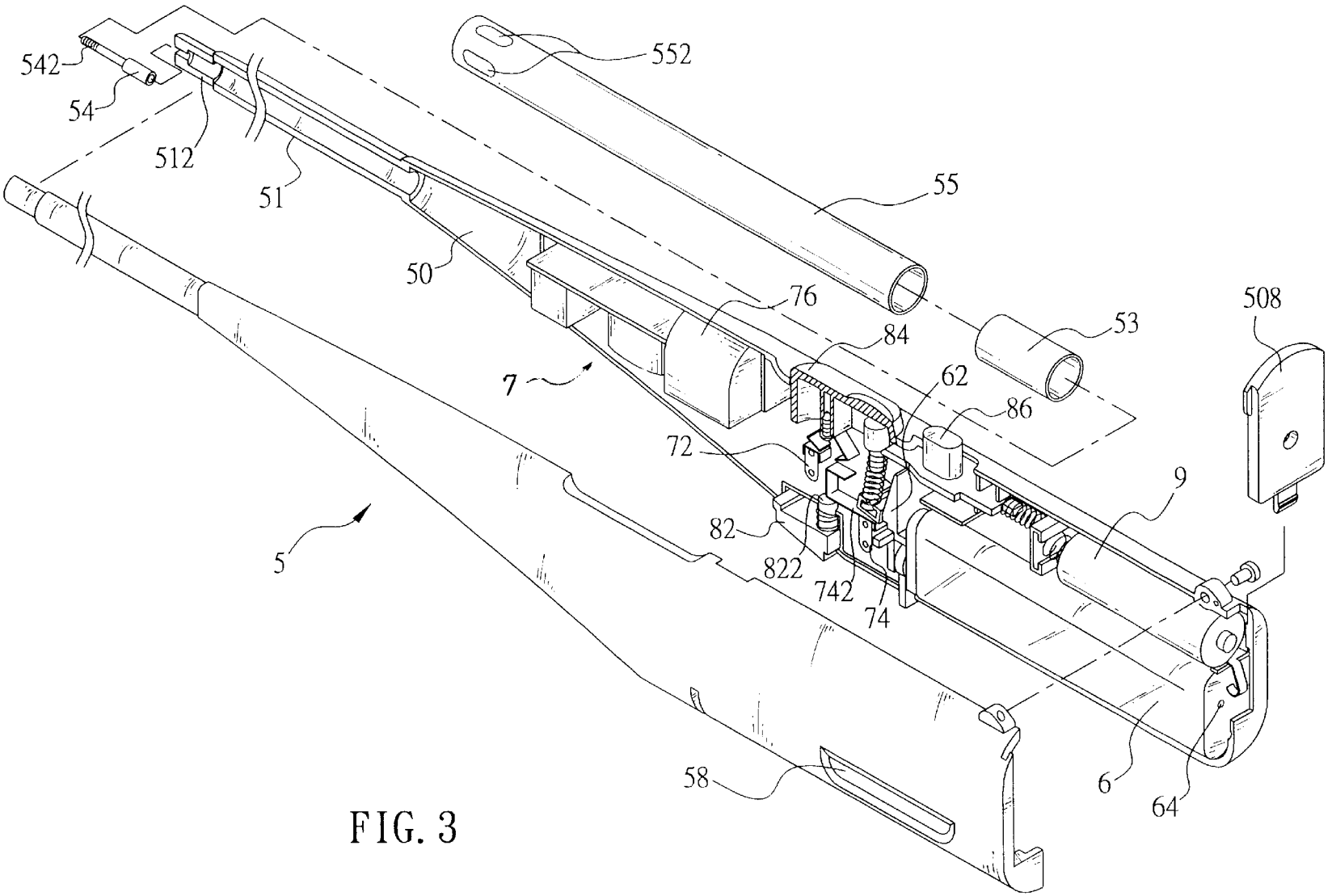
FIG. 3 is an exploded view of a preferred embodiment of electric gas lighter with dual ignition safety device according to the invention.
Figure 4:
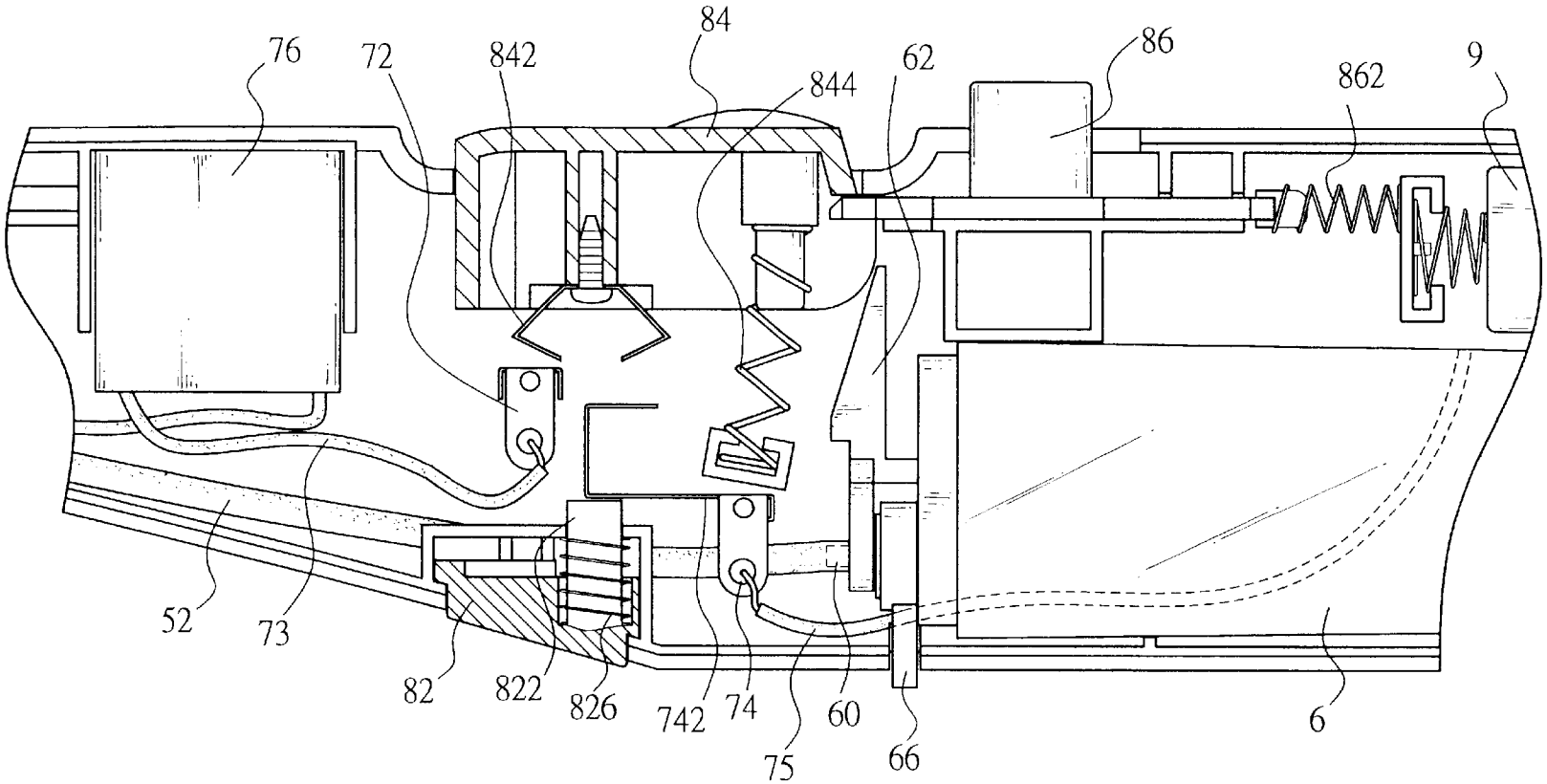
FIG. 4 is a partial cross-sectional view of the FIG. 3 gas lighter wherein the gas lighter is not activated in a locked position.

Referring to FIGS. 3 and 4, there is shown an electric gas lighter constructed in accordance with the invention comprising a housing 5, an ignition button 84, a first safety button 82, a space 50 inside housing 5 for receiving a gas fuel reservoir 6 in the rear bottom portion, a high-voltage circuit device 7, and a source (e.g., cell) 9, a movable second safety button 86 having a front end latched to the rear of ignition button 84, and a spring 862 coupled between second safety button 86 and a fixed member adjacent the source 9.

A slit 58 is provided adjacent gas fuel reservoir 6 for operator observing the remained gas level of gas fuel reservoir 6. A gas inlet 64 is provided in the rear of gas fuel reservoir 6 for feeding gas when gas is low. Gas outlet 60 is in the front of gas fuel reservoir 6 coupled to a hose 52. A gas adjusting level 66 is provided between gas outlet 60 and gas fuel reservoir 6 having one side raised below housing 5. Pivot plate 62 of gas fuel reservoir 6 is adjacent gas adjusting level 66 having the top portion always in contact with the bottom portion of ignition button 84.

A tube 51 is formed in the front of the tapered housing 5. Tube 51 comprises a tapered tube 512 in the front. An ignition tube 54 has one end received in tapered tube 512 being in communication with hose 52 and the other end (i.e., shaft) extended beyond tapered tube 512. A spring 542 is put on the shaft of ignition tube 54 for regulating the gas flow in order to mix gas and air well, resulting in a good burning. A sleeve 53 is put on tapered tube 512 for fixing ignition tube 54. A conductive tube 55 is put on sleeve 53 and tube 51. Conductive tube 5 has a plurality of holes 552 in the front adjacent sleeve 53 for introducing external air into ignition tube 54.

Ignition button 84 is provided in the space 50 with top portion raised above housing 5. Ignition button 84 comprises a conductive contact 842 and a spaced spring 844 both projected below the bottom side wherein spring 844 is anchored in a fixed member inside space 50, thus enabling the up-and-down elastic movement of ignition button 84. First safety button 82 is provided in the space 50 with bottom portion raised below housing 5. First safety button 82 comprises a stud 822 projected from the top side and a spring 826 put on stud 822, thus enabling the up-and-down elastic movement of first safety button 82. High-voltage circuit device 7 comprises two contacts 72, 74 and a high-voltage generator 76. Contact 72 is electrically coupled to high-voltage generator 76 and ignition tube 54 through cable 73, while contact 74 is electrically coupled to source 9 through cable 75. A conductive pad 742 is coupled between contact 74 and stud 822. A cover 508 is provided adjacent source 9 in the rear end of space 50. As such, operator may remove the cover 508 to replace source 9 when source 9 is consumed.

Figure 5:
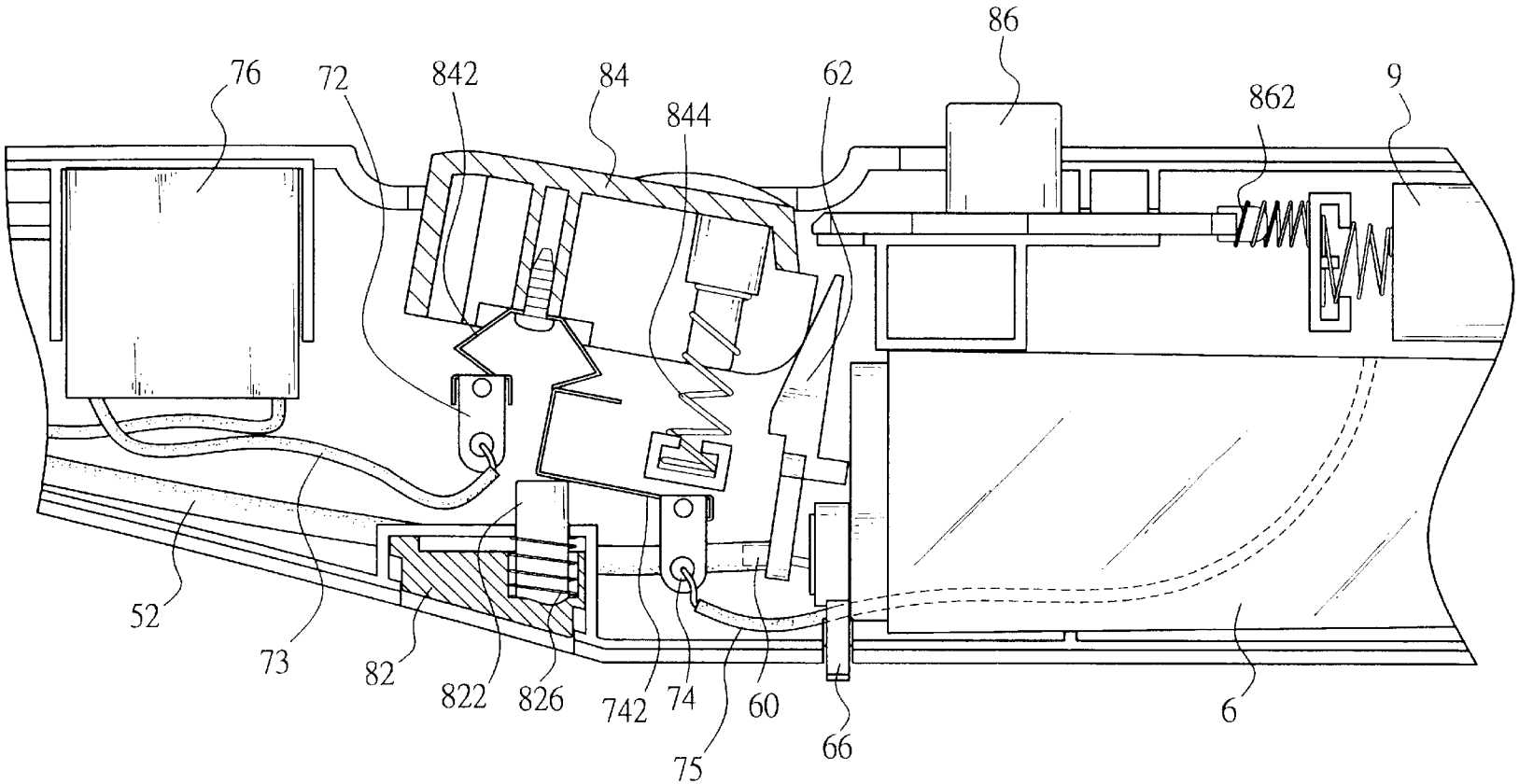
FIG. 5 is a view similar to FIG. 4 wherein the gas lighter is activated in an unlocked position.

Referring to FIG. 5, the operation of the electric gas lighter will now be described in detail below. First, operator uses one hand to push second safety button 86 rearward to compress spring 862 for disengaging second safety button 86 from ignition button 84. Then operator use the other hand to depress ignition button 84 and first safety button 82 to cause conductive contact 842 to move downward and conductive pad 742 to pivot upward respectively until conductive contact 842 contacts conductive pad 742 and contact 72 respectively, thus forming an electrical path from source 9 to high-voltage circuit device 7 to excite a high-voltage current from high-voltage generator 76. The current is flowed to ignition tube 54 and conductive tube 55 for generating an electric arc therebetween. At the same time, pivot plate 62 is pivoted by the depressed ignition button 84 to open the gas outlet 60. Then gas is flowed to ignition tube 54 through hose 52. Thus a spark is generated at the mouth of ignition tube 54, resulting in the ignition of gas lighter. This is an unlocked position of gas lighter.

When the purpose of ignition is achieved, operator may release ignition button 84, first safety button 82, and second safety button 86. Then ignition button 84 is returned to its original position by virtue of spring 844, first safety button 82 is returned to its original position by virtue of spring 826, and second safety button 86 is returned to its original position by virtue of spring 862 respectively. This is a locked position of gas lighter as shown in FIG. 4.

It is designed by the invention that a depressed second safety button 86 or first safety button 82 can not activate the high-voltage circuit device 7. That is, the gas lighter is ignited only when the second safety button 86, the first safety button 82, and the ignition button 84 all are activated. Thus the invention can prevent inadvertent ignition of ignition button 84 by, for example, young children.

While the invention herein disclosed has been described by means of specific embodiments, numerous modifications and variations could be made thereto by those skilled in the art without departing from the scope and spirit of the invention set forth in the claims.

What is claimed is:

1. An electric gas lighter comprising:

a housing including an inside space for receiving a gas fuel reservoir having a gas outlet coupled to a hose being in communication with an ignition tube in the front of the space, a conductive tube adjacent the ignition tube, and a pivot plate adjacent the gas fuel reservoir;

an ignition button in the space with a top portion raised above the housing and a bottom portion in contact with the pivot plate, the ignition button including a conductive contact and a spaced first spring for enabling an up-and-down elastic movement of the ignition button;

a first safety button in the space with a bottom portion raised below the housing including a stud projected from a top side and a second spring put on the stud for enabling an up-and-down elastic movement of the first safety button;

a high-voltage circuit device including a high-voltage generator, a first contact electrically coupled to the high-voltage generator and the ignition tube, a second contact electrically coupled to a source, and a conductive pad coupled between the second contact and the stud, wherein in use depress the ignition button and the first safety button to cause the conductive contact to move downward and the conductive pad to pivot upward respectively until the conductive contact contacts the conductive pad and the first contact, thus forming an electrical path from the source to the high-voltage circuit device to excite a high-voltage current from the high-voltage generator, the current is flowed to the ignition tube and the conductive tube for generating an electric arc therebetween, and the pivot plate is pivoted by the depressed ignition button to open the gas outlet to introduce gas to the ignition tube through the hose, thus generating a spark at the ignition tube to ignite the gas lighter.

2. The electric gas lighter of claim 1, the gas fuel reservoir further comprises a gas inlet in the rear for feeding gas when gas is low.

3. The electric gas lighter of claim 1, further comprising an adjusting level between the gas outlet and the gas fuel reservoir having a side raised below the housing for adjusting the flow of gas from the gas fuel reservoir.

4. The electric gas lighter of claim 1, wherein the housing is tapered from the center toward the front to form a tube member comprising a tapered portion in the front with one end of the ignition tube received therein and the other end of the ignition tube extended beyond the tapered portion, the housing further comprising a sleeve put on the tapered portion for fixing the ignition tube and a conductive tube put on the sleeve and the tube member.

5. The electric gas lighter of claim 1, further comprising a second safety button in the space with a top portion raised above the housing and a front end latched to the ignition button, and a third spring coupled to the rear of the second safety button such that the second safety button is rearward movable to compress the third spring for disengaging from the ignition button.

* * * * *